US009745155B2

(12) United States Patent
Oguri et al.

(10) Patent No.: US 9,745,155 B2
(45) Date of Patent: Aug. 29, 2017

(54) IMAGE-FORMING APPARATUS HAVING SHEET-SUPPLYING DEVICE TO WHICH ADDITIONAL SHEET-SUPPLYING DEVICE IS ATTACHABLE

(71) Applicant: Brother Kogyo Kabushiki Kaisha, Nagoya-shi, Aichi-ken (JP)

(72) Inventors: Ryoko Oguri, Nagoya (JP); Isao Fukuchi, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/076,104

(22) Filed: Mar. 21, 2016

(65) Prior Publication Data

US 2016/0291519 A1 Oct. 6, 2016

(30) Foreign Application Priority Data

Mar. 30, 2015 (JP) ..... 2015-068297

(51) Int. Cl.
*B65H 5/36* (2006.01)
*B65H 1/26* (2006.01)
(Continued)

(52) U.S. Cl.
CPC ..... *B65H 1/266* (2013.01); *B65H 5/26* (2013.01); *B65H 5/36* (2013.01); *G03G 15/6502* (2013.01); *G03G 21/1623* (2013.01); *B65H 2402/10* (2013.01); *B65H 2402/64* (2013.01); *B65H 2403/541* (2013.01); *B65H 2404/611* (2013.01); *B65H 2405/113* (2013.01);
(Continued)

(58) Field of Classification Search
CPC ..... B65H 1/266; B65H 2405/332; G03G 15/6502; G03G 2221/1654
USPC ..... 271/9.11
See application file for complete search history.

(56) References Cited

U.S. PATENT DOCUMENTS 6,102,386 A * 8/2000 Shigetomi ..... B65H 3/44 271/162
7,699,304 B2 * 4/2010 Yamamoto ..... G03G 15/6561 271/162
(Continued)

FOREIGN PATENT DOCUMENTS

JP H05-188715 A 7/1993
JP H06-179532 A 6/1994
(Continued)

*Primary Examiner* — Patrick Cicchino
(74) *Attorney, Agent, or Firm* — Banner & Witcoff, Ltd.

(57) ABSTRACT

An image-forming apparatus includes: a casing; a first sheet tray provided in a bottom portion of the casing; an image-forming unit configured to form an image on a sheet supplied from a sheet accommodation portion of the first sheet tray; a sheet supplying path; a first conveying path; and a shutter. The sheet supplying path is configured to provide communication between the sheet accommodation portion and the image-forming unit. The first conveying path is provided in one of the casing and the first sheet tray, and has one end formed with an opening and another end configured to communicate with the sheet supplying path, the opening being open downward. The shutter is movable between a closing position closing the first conveying path and an opening position opening the first conveying path.

14 Claims, 11 Drawing Sheets

(51) Int. Cl.
*G03G 15/00* (2006.01)
*G03G 21/16* (2006.01)
*B65H 5/26* (2006.01)

(52) U.S. Cl.
CPC .. *B65H 2405/313* (2013.01); *B65H 2601/521* (2013.01); *B65H 2801/06* (2013.01); *G03G 2221/1654* (2013.01)

(56) References Cited

U.S. PATENT DOCUMENTS 7,871,067 B2 * 1/2011 Lim ..... B65H 3/66 271/145
8,657,278 B2 * 2/2014 Ozeki ..... G03G 15/6502 271/10.04
8,787,814 B2 * 7/2014 Watanabe ..... B65H 1/26 399/393
8,905,399 B2 * 12/2014 Murashima ..... B65H 3/0684 271/164
9,033,331 B2 * 5/2015 Arimura ..... B65H 1/08 271/162
9,061,853 B2 * 6/2015 Okabe ..... B65H 5/26
9,085,433 B2 * 7/2015 Aoki ..... G03G 21/16
2012/0048194 A1 3/2012 Watanabe et al.
2015/0001793 A1 1/2015 Arimura et al.

FOREIGN PATENT DOCUMENTS

JP H06-221379 A 8/1994
JP H08-073058 A 3/1996
JP 2006-256811 A 9/2006
JP 2012-051675 A 3/2012
JP 2012-206840 A 10/2012
JP 2014-091606 A 5/2014
JP 2015-011093 A 1/2015

* cited by examiner

IMAGE-FORMING APPARATUS HAVING SHEET-SUPPLYING DEVICE TO WHICH ADDITIONAL SHEET-SUPPLYING DEVICE IS ATTACHABLE

CROSS REFERENCE TO RELATED APPLICATION

This application claims priority from Japanese Patent Application No. 2015-068297 filed Mar. 30, 2015. The entire content of the priority application is incorporated herein by reference.

TECHNICAL FIELD

The present disclosure relates to an image forming apparatus and a sheet-supplying device provided with a sheet conveying path that is open downward.

BACKGROUND

Japanese Patent Application publication No. 2012-206840 discloses an image-forming apparatus provided with a sheet supplying tray below which an additional sheet-supplying device is attachable as an extension unit. The disclosed device is provided with a sheet supplying path for conveying a sheet accommodated in the sheet supplying tray, and a sheet conveying path provided at the sheet supplying tray. The sheet supplying path is open downward to provide communication with the sheet conveying path. A sheet accommodated in the additional sheet-supplying device can be supplied to the sheet supplying path through the sheet conveying path.

SUMMARY

According to the disclosed image-forming apparatus, the sheet supplying path is open while the additional sheet-supplying device is not attached. Therefore, noises generated by conveying the sheet from the sheet supplying tray may be leaked outside from the sheet supplying path.

In view of the foregoing, it is an object of the present disclosure to provide an image-forming apparatus and a sheet-feeding device capable of suppressing noises from a sheet conveying path.

In order to attain the above and other objects, the disclosure provides an image-forming apparatus that includes a casing, a first sheet tray, an image-forming unit, a sheet supplying path, a first conveying path and a shutter. The casing has a bottom portion having a bottom edge configured to contact an installation surface on which the casing is placed. The first sheet tray is provided in the bottom portion of the casing, the first sheet tray including a sheet accommodation portion configured to accommodate a sheet therein. The image-forming unit is configured to form an image on the sheet supplied from the sheet accommodation portion. The sheet supplying path is configured to provide communication between the sheet accommodation portion and the image-forming unit. The first conveying path is provided in one of the casing and the first sheet tray, the first conveying path having one end formed with an opening and another end configured to communicate with the sheet supplying path, the opening being open downward. The shutter is movable between a closing position closing the first conveying path and an opening position opening the first conveying path.

According to another aspect, the disclosure provides a sheet-supplying device that includes a sheet tray, a sheet supplying path, a conveying path and a shutter. The sheet tray includes a sheet accommodation portion configured to accommodate a first sheet therein. The sheet supplying path is configured to guide the first sheet supplied from the sheet accommodation portion. The conveying path has one end formed with an opening and another end configured to communicate with the sheet supplying path, the opening being open downward, the conveying path being configured to guide a second sheet received through the opening to the sheet supplying path, the sheet supplying path being configured to also guide the second sheet supplied from the conveying path. The shutter is movable between a closing position closing the conveying path and an opening position opening the conveying path.

BRIEF DESCRIPTION OF THE DRAWINGS

The particular features and advantages of the disclosure as well as other objects will become apparent from the following description taken in connection with the accompanying drawings, in which.

DETAILED DESCRIPTION

A laser printer 1 as an example of an image-forming apparatus according to an embodiment will be described while referring to FIGS. 1 through 7B.

Directions in the following description will be based on a perspective of a user using the laser printer 1. Specifically, the right side of the laser printer 1 in FIG. 1 will be called as "front side (near side)," the left side will be called as "rear side (far side)," the far side will be called as "right side," and the near side will be called as "left side." Further, the "top" and "bottom" of the laser printer 1 will correspond to the vertical direction in FIG. 1.

Figure 1:
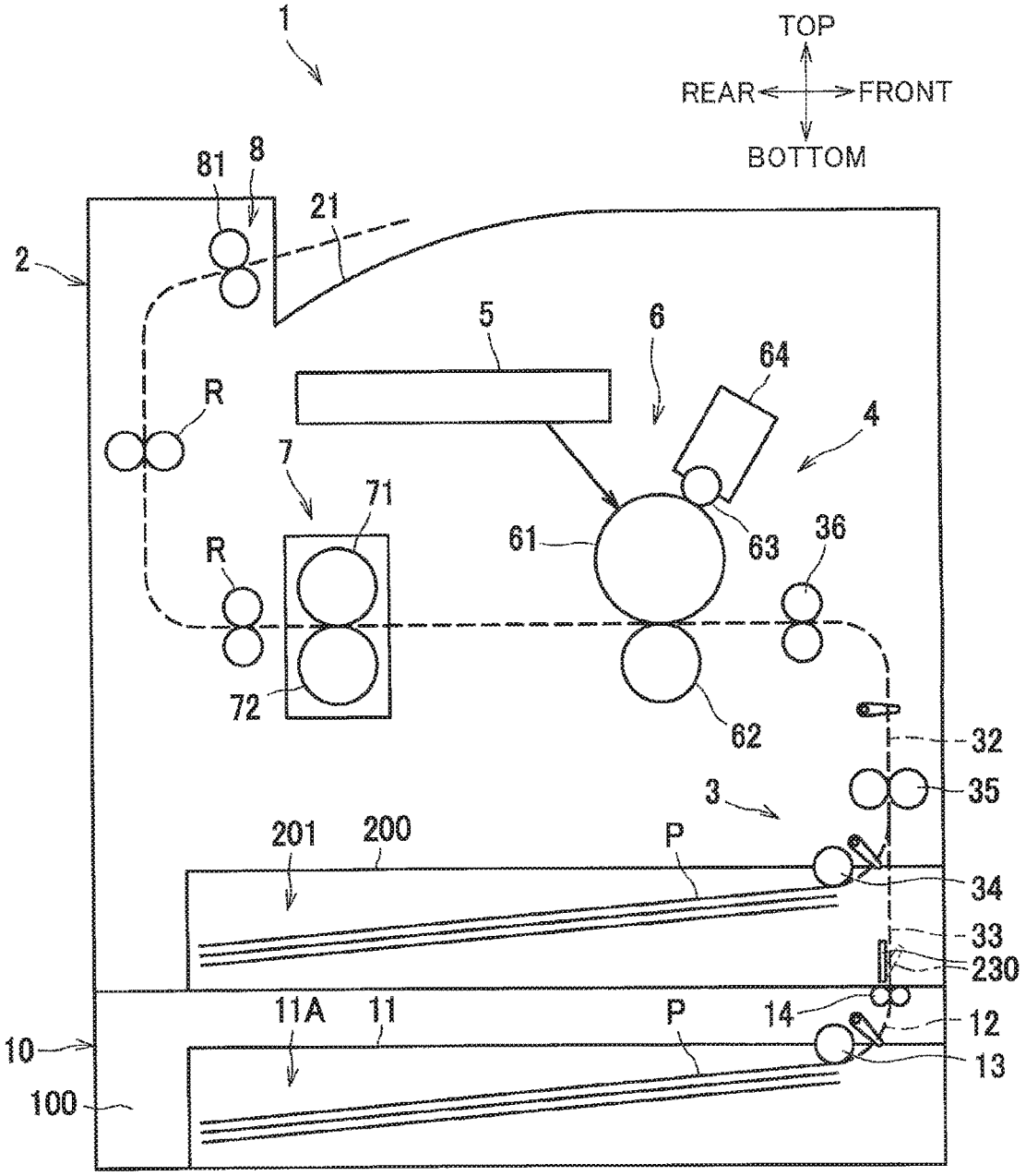
FIG. 1 is a schematic view of a laser printer as an image-forming apparatus according to an embodiment.

As shown in FIG. 1, the laser printer 1 includes a main casing 2, and an additional sheet-supplying device 10 as an extension unit. The additional sheet-supplying device 10 can be attached to a bottom portion of the main casing 2 such that additional sheet-supplying device 10 is positioned below the casing 2. The main casing 2 is provided with a first sheet tray 200, and the additional sheet-supplying device 10 is provided with a second sheet tray 11. In this laser printer 1, an image is configured to be formed on a sheet P supplied from the first sheet tray 200 or from the second sheet tray 11.

Within the main casing 2, provided are a sheet supplying unit 3 as an example of a sheet-supplying device, an image-forming unit 4, and a sheet discharging mechanism 8. Further, a discharge tray 21 is formed in an upper surface of the main casing 2.

The sheet supplying unit 3 includes the first sheet tray 200 as an example of a first Sheet tray, a sheet supply path 32, a first conveying path 33 as an example of a first conveying path, a first pick-up roller 34, a pair of first conveyer rollers 35, and a pair of registration rollers 36.

The first sheet tray 200 includes a first sheet-accommodating portion 201 as an example of a sheet accommodation portion. The first sheet tray 200 is provided in a lower portion of the main casing 2, and can be attached to and detached from the main casing 2. More specifically, the first sheet tray 200 can be detached from the main casing 2 (more specifically, the bottom portion, of the main casing 2) by pulling frontward, and can be attached to the main casing 2 (the bottom portion of the main casing 2) by pushing rearward. Hereinafter, the direction in which the first sheet tray 200 is attached to the main casing 2 (from the front toward the rear) will be called as an attaching direction, whereas the direction in which the first sheet tray 200 is detached from the main casing 2 (from the rear toward the front) will be called as a detaching direction.

The sheet supplying path 32 is adapted to guide the sheet P supplied from the first sheet-accommodating portion 201 to the image-forming unit 4. The sheet supply path 32 provides communication from the first sheet-accommodating portion 201 to the image-forming unit 4. The sheet supplying path 32 extends diagonally upward and frontward from an upper end portion of the first sheet-accommodating portion 201, and then extends upward, and is than curved to extend rearward.

The first pick-up roller 34, the first conveyer rollers 35 and the registration rollers 36 are provided along the sheet supplying path 32.

The first pick-up roller 34 is adapted to pick-up a sheet P in the first sheet tray 200 while being in rotational contact with the sheet P accommodated in the first sheet-accommodating portion 201.

The first conveyer rollers 35 are adapted to convey the sheet P supplied by the first pick-up roller 34 from the first sheet tray 200. The registration rollers 36 are adapted to deliver the sheet P supplied from the first conveyer rollers 35 to the image-forming unit 4 at a prescribed timing.

The first conveying path 33 is adapted to guide the sheet P supplied from the additional sheet-supplying device 10 to the first conveyer rollers 35. The first conveying path 33 is provided at the first sheet tray 200. The first conveying path 33 is positioned upstream of the first sheet-accommodating portion 201 in the attaching direction of the first sheet tray 200. That is, the first conveying path 33 is positioned frontward of the first sheet-accommodating portion 201. The first conveying path 33 extends vertically, and has an upper end portion in communication with the sheet supplying path 32 at a position between the first pick-up roller 34 and the first conveyer rollers 35. The first conveying path 33 has a lower end portion in communication with a second conveying path 12 (described later) of the additional sheet-supplying device 10. A detailed structure of the first sheet tray 200 will be described later.

The image-forming unit 4 is positioned above the first sheet tray 200. The image-forming unit 4 is adapted to form an image on the running sheet P supplied through the sheet supplying path 32 from the first sheet-accommodating portion 201 and from a second sheet accommodating portion 11A (described later) of the additional sheet-supplying device 10.

More specifically, the image-forming unit 4 includes a seamier unit 5, a process unit 6, and a fixing unit 7. The process unit 6 and the fixing unit 7 are adapted to convey the sheet P supplied through the sheet supplying path 32 in the attaching direction of the first sheet tray 200, i.e., from the front to the rear.

The scanner unit 5 is positioned in an upper portion of the main casing 2, and includes a laser emitting part, a polygon mirror, lenses, and reflection mirrors those not shown. The scanner unit 5 is configured to irradiate a laser beam to a surface of a photosensitive drum 61 at high speed scanning.

The process unit 6 includes the photosensitive drum 61, a transfer roller 62, a developing roller 63, and a toner chamber 64.

In the process unit 6, the surface of the photosensitive drum 61 is configured to be exposed to light by the high speed scanning of the laser beam emitted from the seamier unit 5, after the surface of the photosensitive drum 61 is uniformly charged by a charger (not shown). Thus, electrical potential of a light-exposed region is lowered to form an electrostatic latent image based on image data on the surface of the photosensitive drum 61.

Then, toner on the developing roller 63 is configured to be supplied to the electrostatic latent image on the photosensitive drum 61, after the toner in the toner chamber 64 is carried on the developing roller 63, so that a toner image is formed on the surface of the photosensitive dram 61. Then, the toner image on the surface of the photosensitive drum 61 is configured to be transferred on the sheet P when the sheet P supplied through the sheet supplying path 32 is conveyed to a position between the photosensitive drum 61 and the transfer roller 62.

The fixing unit 7 includes a heat roller 71 and a pressure roller 72 facing the heat roller 71 and in pressure contact therewith. The fixing unit 7 is adapted to thermally fix the toner image to the sheet P when the sheet P passes through a position between the heat roller 71 and the pressure roller 72.

Incidentally, the sheet P on which the toner image has been thermally fixed by the fixing unit 7 is configured to be conveyed toward the discharge mechanism 8 by a plurality of pairs of rollers R positioned downstream of the fixing unit 7 in a sheet conveying direction thereof.

The discharge mechanism 8 is positioned above the image-forming unit 4, and is adapted to discharge the imaged sheet P outside of the main casing 2. More specifically, the discharge mechanism 8 includes a pair of discharge rollers 81 positioned above the fixing unit 7 and rearward of the discharge tray 21. The discharge rollers 81 are adapted to discharge the sheet P conveyed from the image-forming unit 4 toward upstream from downstream in the attaching direction of the first sheet tray 200, that is, from the rear side to the front side of the housing 2. The sheet P discharged by the discharge rollers 81 is configured to be placed on the discharge tray 21.

The additional sheet-supplying device 10 is configured to be attached to and detached from the main casing 2. Put another way, the sheet feeding unit 3 is detachably attachable to the main casing 2 above the additional sheet-supplying device 10. The additional sheet-supplying device 10 is an example of another sheet supplying device.

The additional sheet-supplying device 10 includes a frame 100, a second sheet tray 11, the second conveying path 12, a second pick-up roller 13, and a pair of second conveying rollers 14.

The second sheet tray 11 includes the second sheet accommodating portion 11A for accommodating the sheets P therein. The second sheet tray 11 is attachable to and detachable from the frame 100. Specifically, the second sheet tray 11 can be detached from the frame 100 by pulling the second sheet tray 11 forward from the frame 100, and can be attached to the frame 100 by pressing the second sheet tray 11 rearward.

The second conveying path 12 is a path that can provide communication between the second sheet accommodating portion 11A and the first conveying path 33. The second conveying path 12 extends obliquely upward and frontward from an upper-front portion of the second sheet accommodating portion 11A.

The second pick-up roller 13 and the second conveying rollers 14 are provided along the second conveying path 12. The second pick-up roller 13 and the second conveying rollers 14 are configured to supply the sheet P accommodated in the second sheet accommodating portion 11A to the first conveying path 33.

The second pick-up roller 13 is configured to pick up the sheet P by rotating in contact with the sheet P accommodated in the second sheet accommodating portion 11A. The second conveying rollers 14 are rollers for conveying the sheet P supplied by the second pick-up roller 13 from the second sheet accommodating portion. 11A to the first conveying path 33.

With this structure of the additional sheet-supplying device 10, the sheet P stored in the second sheet accommodating portion 11A can be supplied to the image-forming unit 4 through the second conveying path 12, the first conveying path 33, and the supply path 32.

Next, a structure of the first sheet tray 200 will be described in detail.

Figure 2:
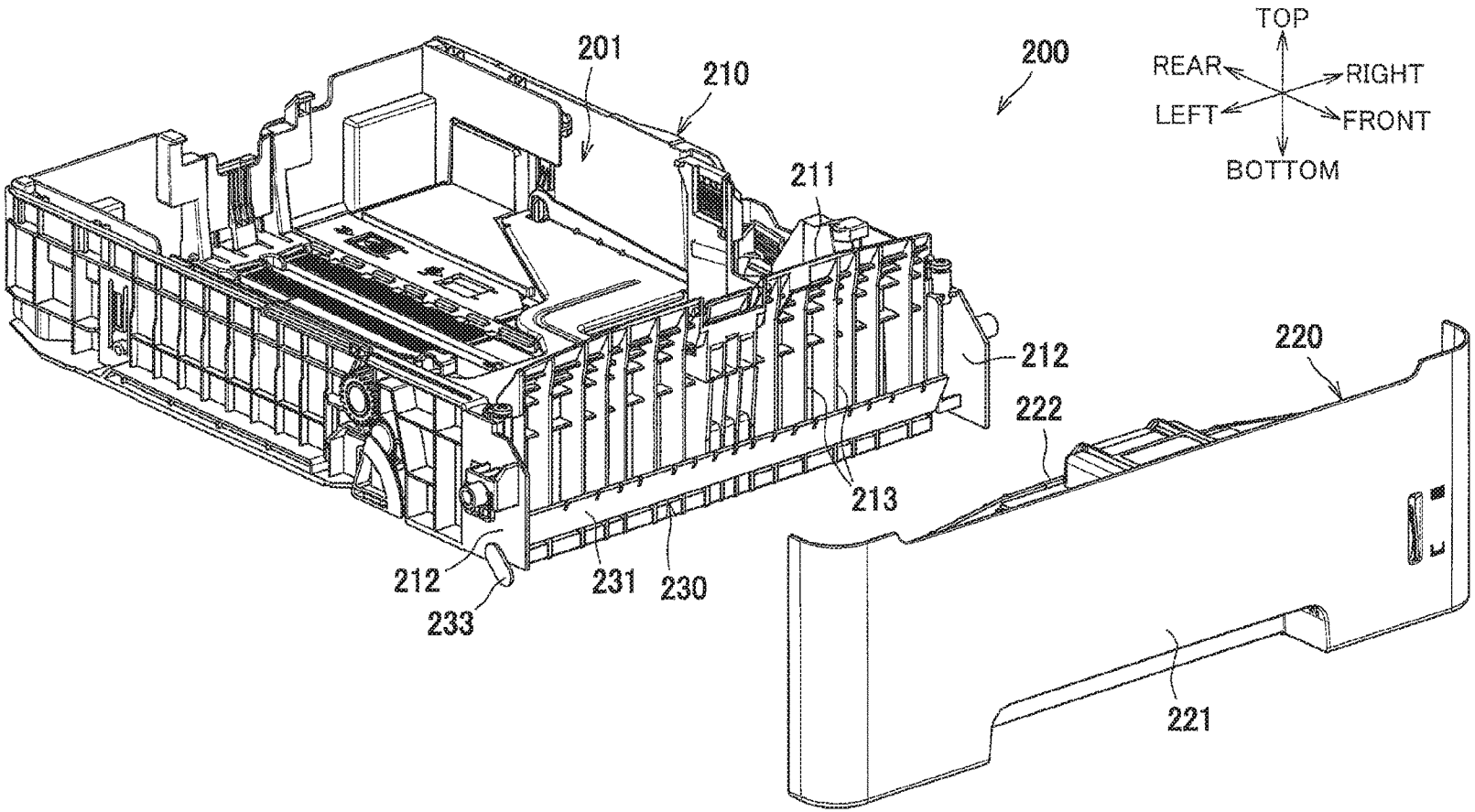
FIG. 2 is an exploded perspective view of a first sheet tray provided in the laser printer according to the embodiment.

As illustrated in FIG. 2, the first sheet tray 200 includes a tray body 210, a cover 220 and a shutter member 230. The tray body 210 and the cover 220 define the first conveying path 33. The shutter member 230 is an example of a shutter configured to open and close the first conveying path 33.

The tray body 210 has a substantially rectangular box shape that opens upward. The tray body 210 defines the first sheet-accommodating portion 201 therein. The tray body 210 includes a front wall 211 and a pair of support walls 212.

The front wall 211 serves as a front wall defining the first sheet-accommodating portion 201. The front wall 211 also serves as a rear wall that defines the first conveying path 33 (see FIG. 5B). The support walls 212 extend forward from right and left ends of the front wall 211, respectively.

The front wall 211 has a front surface on which a plurality of first conveying ribs 213 is formed. The first conveying ribs 213 are arranged to be aligned with one another in a left-right direction. Each of the first conveying ribs 213 extends vertically to span from a lower end to an upper end of the front wall 211.

The cover 220 includes a cover part 221 covering a front portion of the tray body 210, and a guide wall 222 provided rearward of the cover part 221.

Figure 5A:
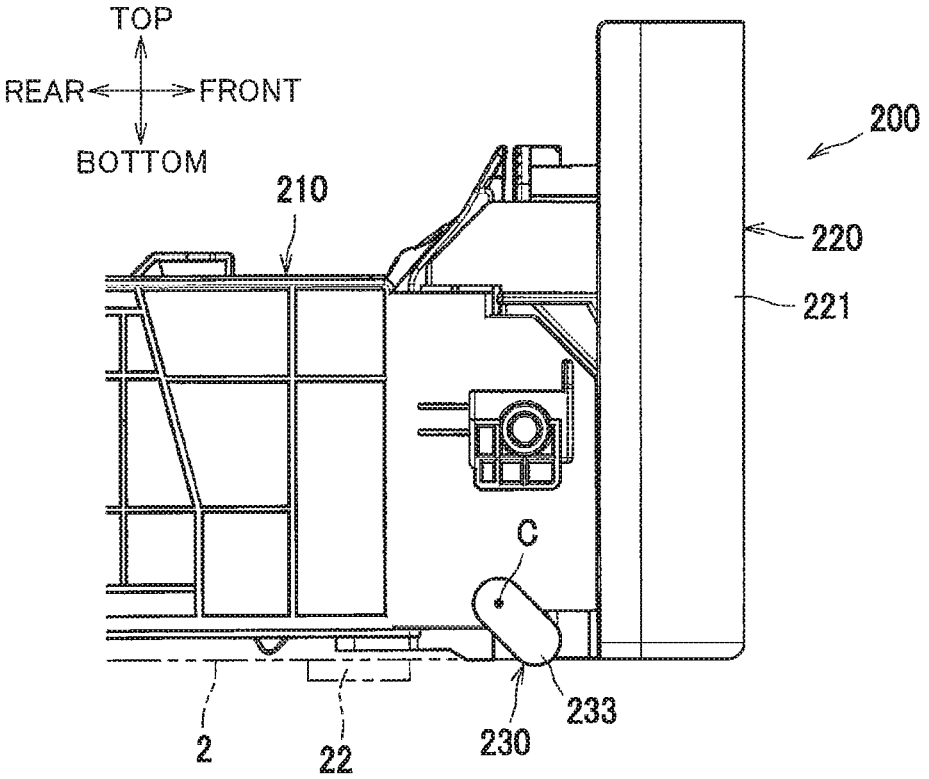
FIG. 5A is a side view of the first sheet tray.
Figure 5B:
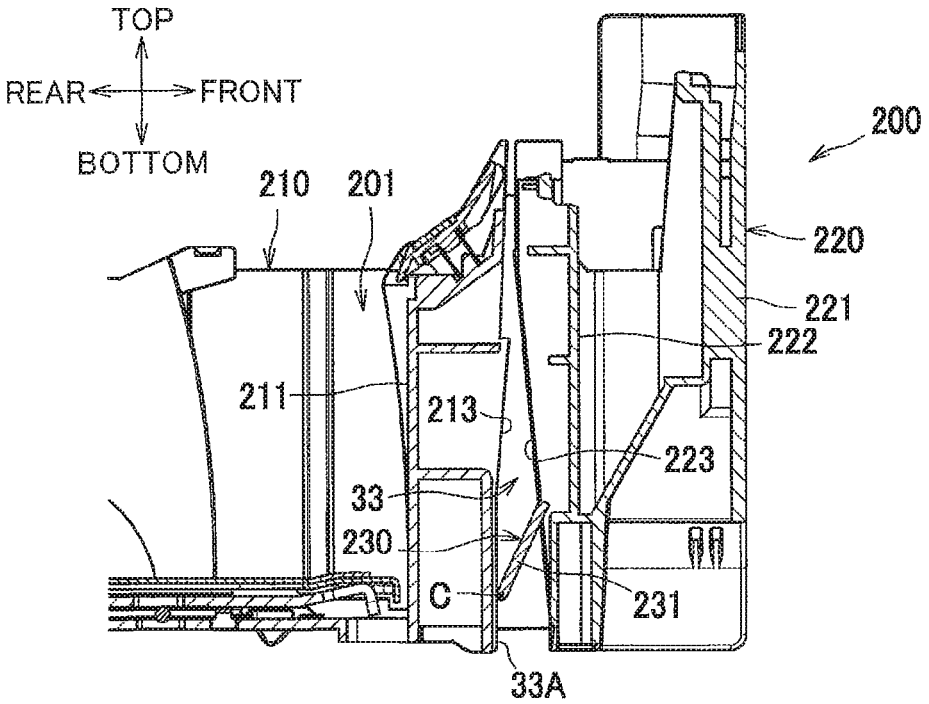
FIG. 5B is a cross-sectional view of the first sheet tray.

As illustrated in FIG. 5B, the guide wall 222 is a wall serving as a front wall defining the first conveying path 33. That is, the first conveying path 33 is defined between the front wall 211 and the guide wall 222. The guide wall 222 is arranged to be spaced away frontward from the front wall 211 of the tray body 210. The guide wall 222 has a rear surface on which a plurality of second conveying ribs 223 is formed. The second conveying ribs 223 extend in the vertical direction and are aligned with one another in the left-right direction. That is, neighboring two second conveying ribs 223 define a gap therebetween.

In the first sheet tray 200, an opening 33A is defined between the front wall 211 of the tray body 210 and the guide wall 222 of the cover 220. This opening 33A is open downward and is in communication with the first conveying path 33 to function as an inlet of the first conveying path 33. In other words, the first conveying path 33 can communicate with the second conveying path 12 of the attached additional sheet-supplying device 10 via the opening 33A. As the sheet supply path 32 (see FIG. 1) is in communication with the first conveying path 33, the first conveying path 33 is configured to guide the sheet P received from the second conveying path 12 through the opening 33A to the sheet supply path 32.

Figure 3:
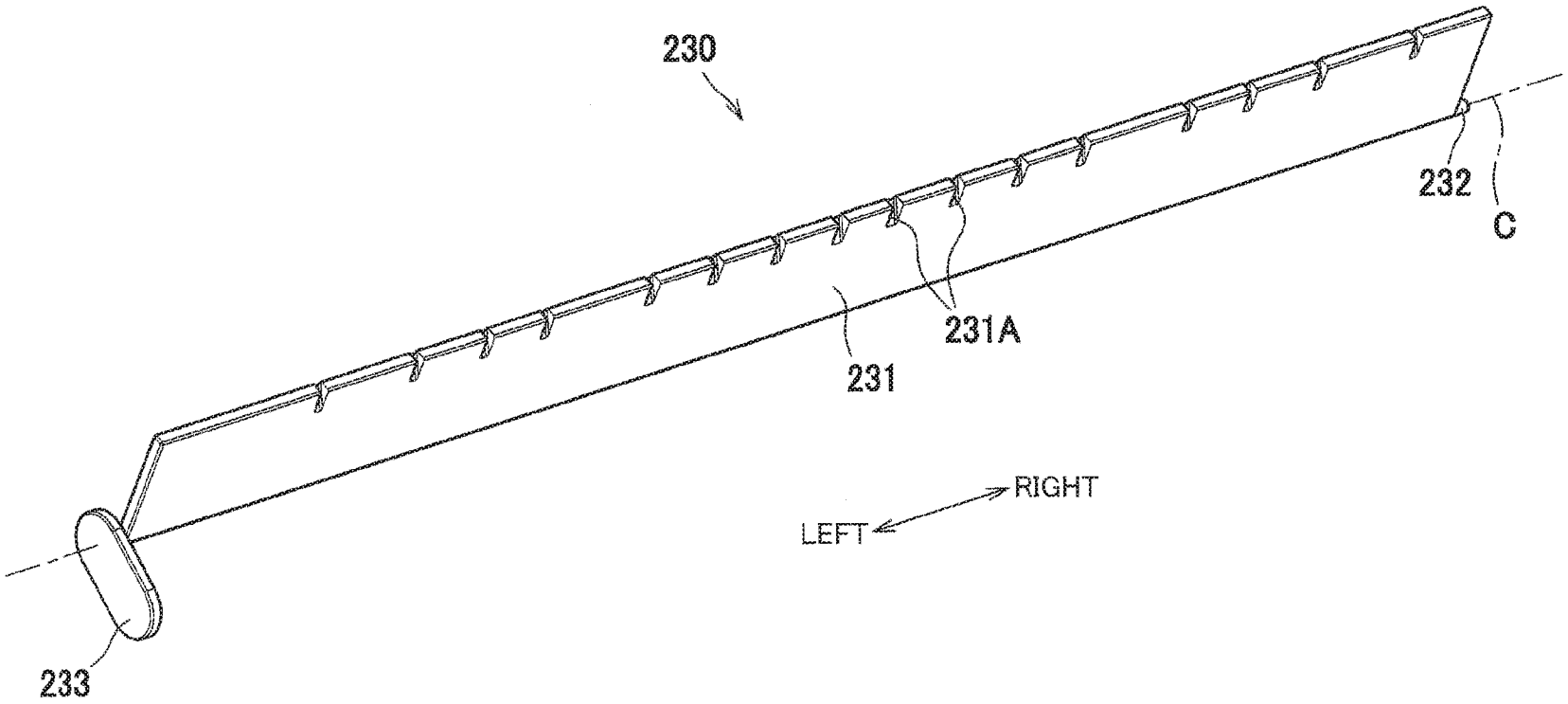
FIG. 3 is a perspective view of a shutter member provided in the laser printer according to the embodiment.

The shutter member 230 is pivotally movably supported by the tray body 210. As illustrated in FIG. 3, the shutter member 230 includes a shutter part 231, a pair of shaft parts 232 (only the right one is shown in FIG. 3), and an acting part 233. The shutter part 231 has a plate-like shape that is elongated in the left-right direction. That is, the front-rear direction corresponds to a short-side direction of the shutter part 231. The shaft parts 232 protrude outward in the left-right direction respectively from the shutter part 231. The acting part 233 is provided to the left of the shutter part 231.

The shaft parts 232 are provided one on each end face of the shutter part 231 in the left-right direction. More specifically, each shaft part 232 is provided on a rear end of the corresponding end face (right or left end face) of the shutter part 231. The rear end of each end face of the shutter part 231 is one end in the short-side direction of the shutter part 231. The shaft parts 232 are rotatably supported by lower end portions of the respective support walls 212 of the tray body 210 (see FIG. 2). Referring to FIG. 3, an imaginary line C is defined as an axis C that passes through centers of the shaft parts 232. The shutter member 230 is supported by the tray body 210 such that the shutter member 230 can pivotally move about the axis C between an opening position (shown in FIG. 6B) and a closing position (shown in FIG. 5B). In the opening position shown in FIG. 6B, the shutter part 231 opens the first conveying path 33. In the closing position shown in FIG. 5B, the shutter part 231 closes the first conveying path 33.

Figure 6A:
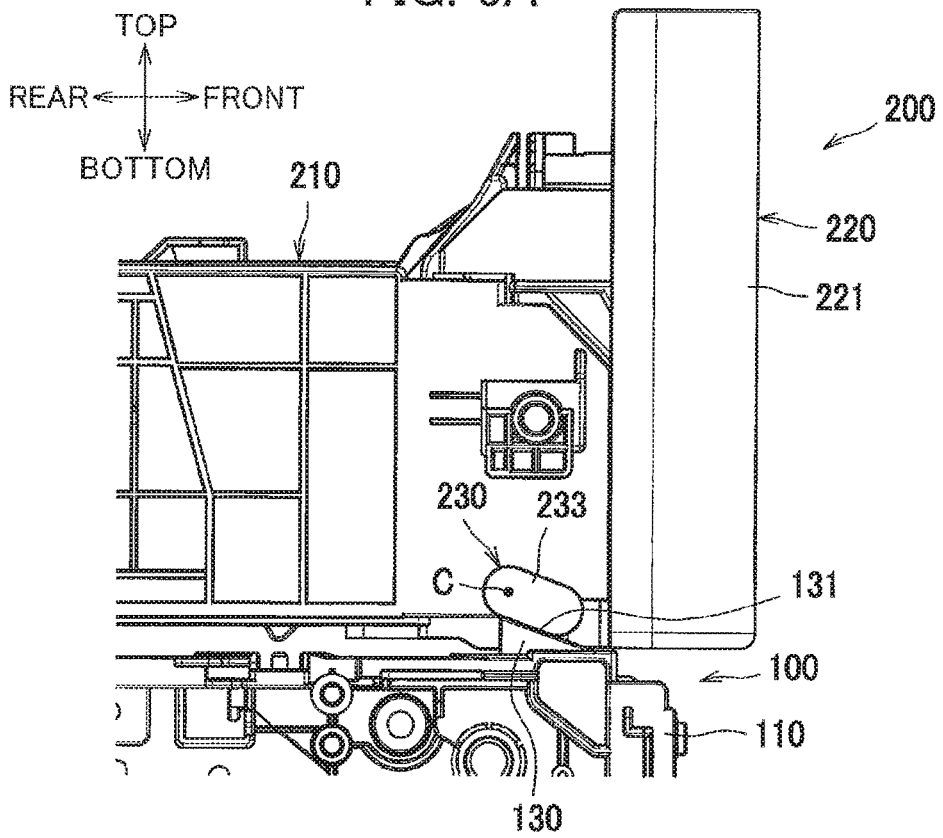
FIG. 6A is a side view illustrating the first sheet tray and the frame of the additional sheet-supplying device in a state where the additional sheet-supplying device is attached to a main casing of the laser printer according to the embodiment.
Figure 6B:
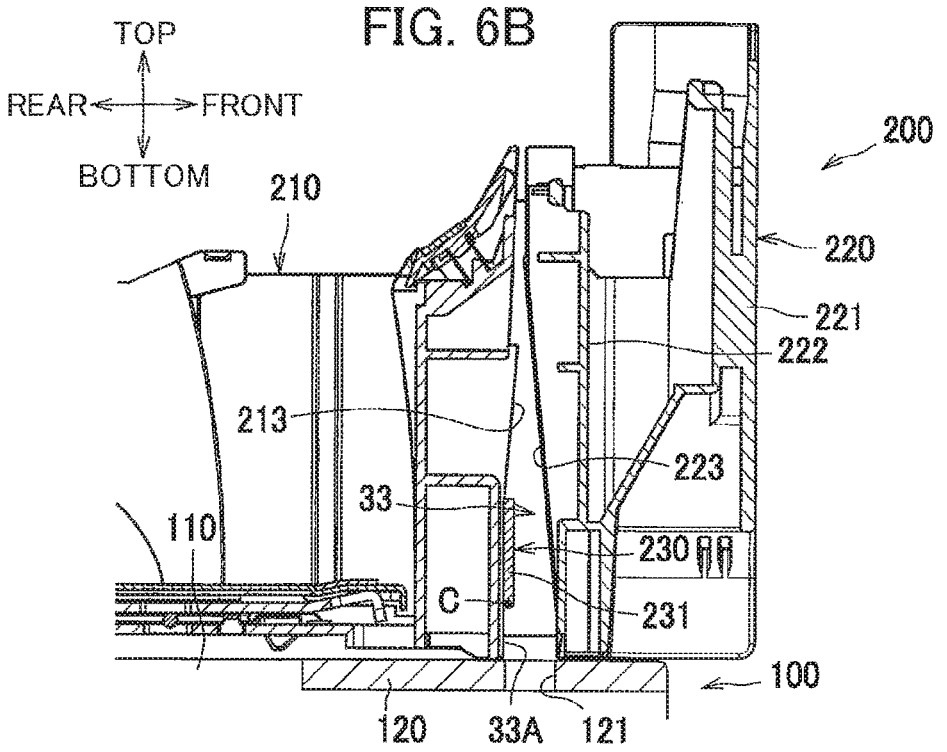
FIG. 6B is a cross-sectional view illustrating the first sheet tray and the frame of the additional sheet-supplying device in a state where the additional sheet-supplying device is attached to the main casing of the laser printer according to the embodiment.

As illustrated in FIG. 6B, when the shutter member 230 is in the opening position, a free end portion of the shutter part 231 is positioned above than the rear end of the shutter part 231 provided with the shaft parts 232 in the vertical direction. Specifically, when the shutter member 230 is in the opening position, the shutter part 231 is disposed in such an orientation that: the free end portion of the shutter part 231 is directed toward downstream in a conveying direction of the sheet P in the first conveying path 33; and the shutter part 231 extends in the sheet conveying direction. In contrast, as illustrated in FIG. 5B, when the shutter member 230 is in the closing position, the shutter part 231 is collapsed toward frontward and is arranged to intersect with the conveying direction of the sheet P in the first conveying path 33, thereby closing the first conveying path 33.

As illustrated in FIG. 3, a plurality of slits 231A is formed in the free end portion of the shutter part 231. The slits 231A are provided at positions corresponding to the second conveying ribs 223 formed on the guide wall 222 in the left-right direction. As illustrated in FIG. 5B, when the shutter member 230 is in the closing position, a portion of the shutter part 231 between two neighboring slits 231A enters into a corresponding gap between two neighboring second conveying ribs 223; and a bottom portion of each slit 231A of the shutter part 231 abuts on a tip end of the corresponding second conveying rib 223.

As illustrated in FIGS. 2 and 3, the acting part 233 is provided on a left end of the left shaft part 232. The acting part 233 is arranged leftward of the support wall 212. The acting part 233 is thus integrally movable with the shutter part 231. In a side view, the acting part 233 extends radially outward from the axis C. As illustrated in FIG. 5A, when the shutter member 230 is in the closing position, a free end of the acting part 233 is positioned obliquely downward and frontward relative to the axis C.

The shutter member 230 is formed to have such a weight-distribution that the shutter member 230 is normally positioned at the closing position by its own weight. Alternatively, the shutter member 230 may be configured to be normally urged toward the closing position by an urging member. The shutter member 230 is restricted to be placed in the closing position by abutment of the shutter part 231 against the second conveying ribs 223.

As shown in FIG. 5A, the shutter member 230 as a whole is arranged above a lower edge of the main casing 2. Specifically, the main casing 2 includes leg portions 22 protruding downward from a bottom surface constituting the main casing 2. The leg portions 22 are configured to abut on an installation surface on which the main casing 2 is disposed without the additional sheet-supplying device 10. When the shutter member 230 is in the closing position, the entire shutter member 230 is positioned above lower edges of the leg portions 22.

The shutter member 230 is configured to be placed at the closing position when the main casing 2 (sheet supplying unit 3) is not provided with the additional sheet-supplying device 10. However, when the additional sheet-supplying device 10 is attached to the main casing 2 (sheet supplying unit 3), the acting part 233 can abut on a part of the additional sheet-supplying device 10, thereby moving the shutter member 230 from the closing position to the opening position.

Next, a detailed configuration of the frame 100 of the additional sheet-supplying device 10 will be described.

Figure 4:
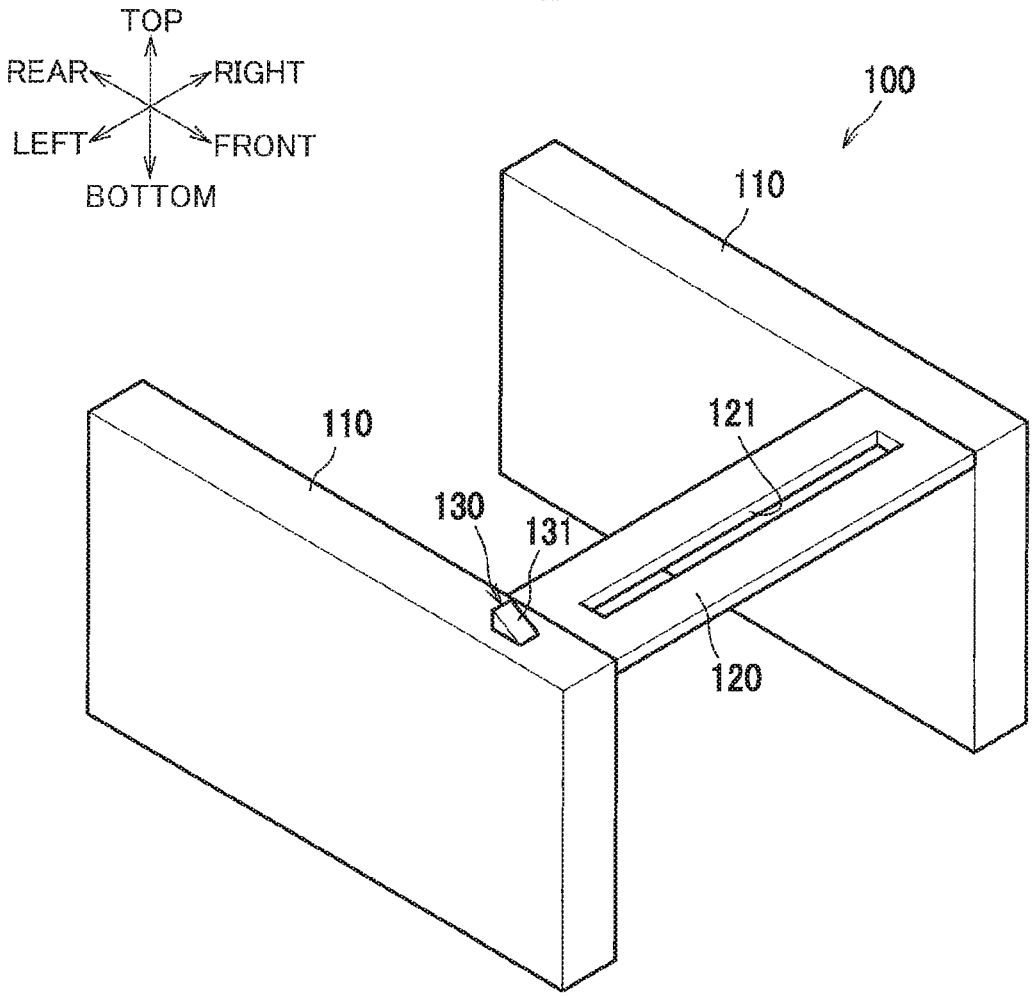
FIG. 4 is a perspective view of a frame of an additional sheet-supplying device attachable to the laser printer according to the embodiment.

As illustrated in FIG. 4, the frame 100 of the additional sheet-supplying device 10 includes a pair of (left and right) side frames 110, a bridging member 120, and a shutter actuating part 130.

The bridging member 120 is provided to connect upper front end portions of the respective side frames 110. The bridging member 120 is formed with a communication hole 121 that penetrate through the bridging member 120 vertically. The communication hole 121 is elongated in the left-right direction and is in communication with the second conveying path 12. That is, the communication hole 121 constitutes an exit of the second conveying path 12. As illustrated in FIG. 6B, when the additional sheet-supplying device 10 is attached to the main casing 2, the communication hole 121 is arranged below the opening 33A to provide communication between the second sheet accommodating portion 11A and the opening 33A.

As illustrated in FIG. 4, the shutter actuating part 130 is provided on the left side frame 110. The shutter actuating part 130 protrudes upward from an upper surface of the left side frame 110. The shutter actuating part 130 has a substantially triangular shape in a side view. The shutter actuating part 130 has an inclined surface 131 that slopes downward toward upstream in the attaching direction of the first sheet tray 200, that is, from the rear to the front. Put another way, the inclined surface 131 has a height in the vertical direction that becomes smaller toward upstream in the attaching direction of the first sheet tray 200. The shutter actuating part 130 is an example of a shutter actuating part In the above-configured shutter actuating part 130, as illustrated in FIG. 6A, the inclined surface 131 can abut on the acting part 233 of the shutter member 230 to pivotally move the shutter member 230 from the closing position to the opening position, when the main casing 2 is placed and attached on the additional sheet-supplying device 10; and when the first sheet tray 200 is inserted into the main casing 2 to which the additional sheet-supplying device 10 has been attached.

With the above-described configuration of laser printer 1 according to the embodiment, following operational and technical advantages can be achieved.

When the laser printer 1 is used alone without the additional sheet-supplying device 10, as illustrated in FIGS. 5A and 5B, the shutter member 230 is in the closing position and closes the first conveying path 33. Accordingly, this structure can suppress leaking out of noises from the opening 33A during operation of the laser printer 1.

Further, since the shutter member 230 is positioned above the lower edge of the main casing 2, the shutter member 230 does contact the installation surface on which the laser printer 1 is disposed. Accordingly, when the additional sheet-supplying device 10 is not attached to the main housing 2, the shutter member 230 can be free from any load and can be prevented from being accidentally pivoted to the opening position due to abutment of the shutter member 230 against the installation surface.

For attaching the additional sheet-supplying device 10 to the main casing 2, the main casing 2 is placed on the additional sheet-supplying device 10 as illustrated in FIG. 1. At this time, the acting part 233 of the shutter member 230 abuts on the shutter actuating part 130 of the additional sheet-supplying device 10, which causes the acting part 233 to pivotally move upward (counterclockwise), as illustrated in FIG. 6A. As a result, the shutter member 230 is moved from the closing position to the opening position shown in FIG. 6B and opens the first conveying path 33.

In this way, attachment of the additional sheet-supplying device 10 to the main casing 2 can automatically move the shutter member 230 to the opening position. No extra operation is required for a user to open the shutter member 230, and an improved operability can be realized.

When the first conveying path 33 is opened, the opening 33A and the communication hole 121 are in communication with each other. Hence, the sheet P accommodated in the second sheet accommodating portion 11A of the additional sheet-supplying device 10 can be conveyed to the image-forming unit 4 through the first conveying path 33.

In the opening position, the free end of the shutter part 231 is located above the axis C, as shown in FIG. 6B. Accordingly, a leading end of the sheet P entering the first conveying path 33 through the communication hole 121 is less likely to get stuck with the shutter part 231 than if the free end of the shutter part 231 was arranged below the axis C. Thus, this configuration can suppress the sheet P from getting jammed.

Figure 7A:
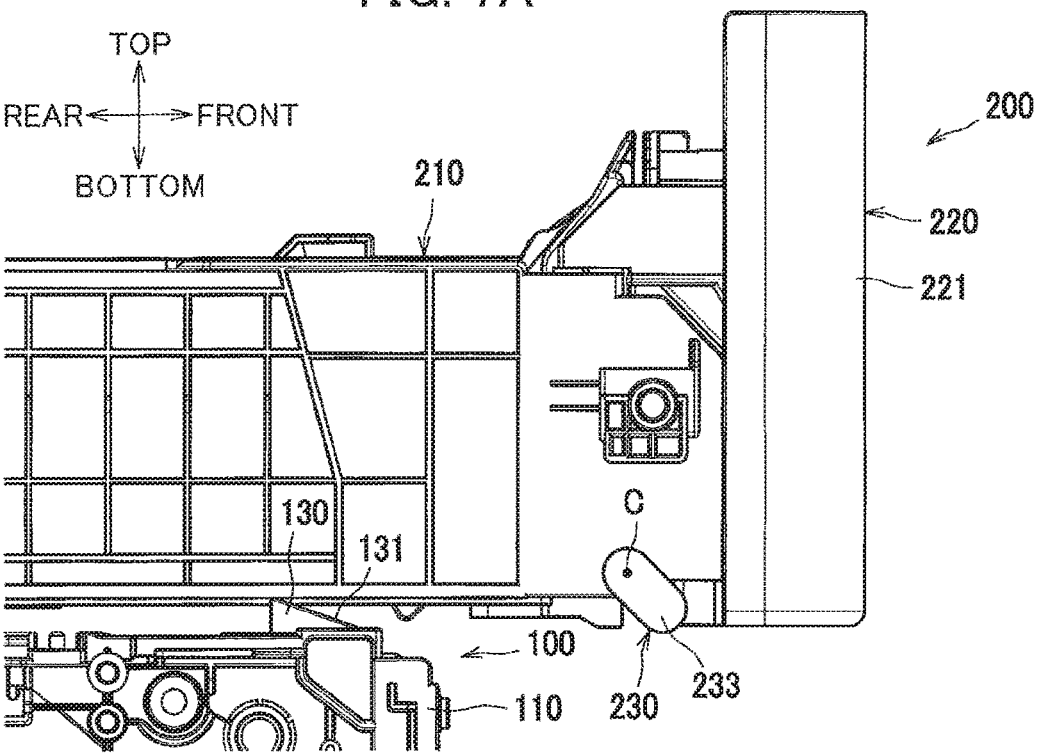
FIG. 7A is a side view illustrating the first sheet tray and the frame of the additional sheet-supplying device in a state where the first sheet tray is withdrawn from the main casing of the laser printer according to the embodiment.
Figure 7B:
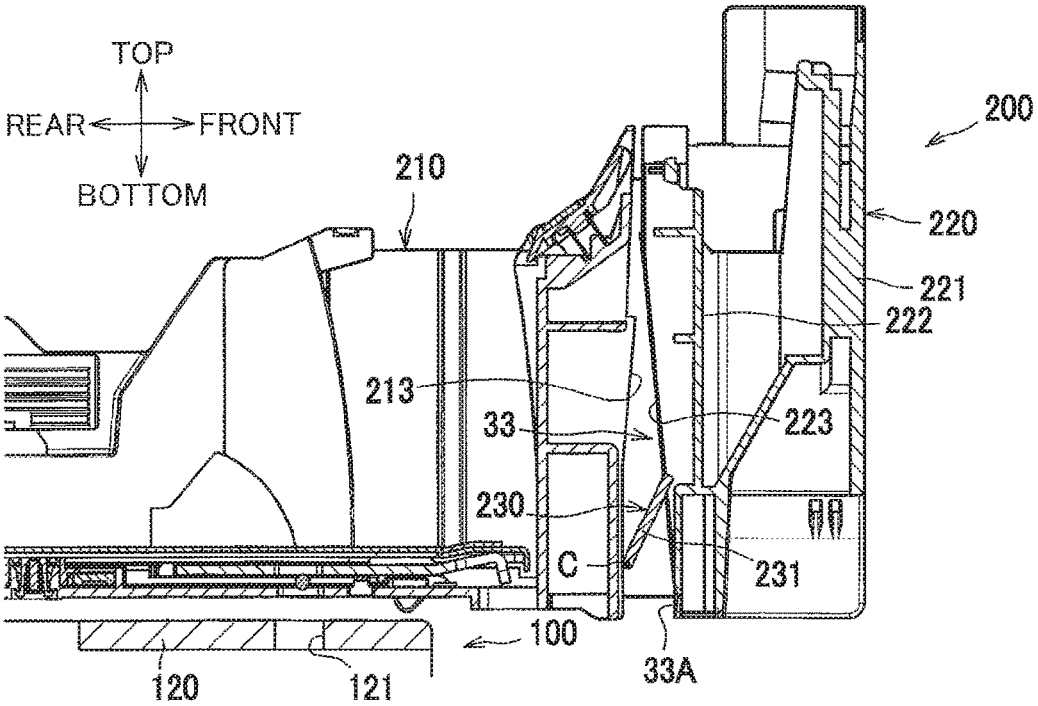
FIG. 7B is a cross-sectional view illustrating the first sheet tray and the frame of the additional sheet-supplying device in a state where the additional sheet-supplying device is withdrawn from the main casing of the laser printer according to the embodiment.

When the first sheet tray 200 is withdrawn frontward from the main casing 2, the acting part 233 of the shutter member 230 is separated from the shutter actuating part 130, as illustrated in FIG. 7A. As a result, as illustrated in FIG. 7B, the shutter member 230 is moved from the opening position to the closing position due to its own weight, thereby closing the first conveying path 33. In this way, since the first conveying path 33 can be closed when the first sheet tray 200 is pulled out from the main casing 2, this configuration can suppress foreign matters from entering into the first conveying path 33 through the opening 33A.

When the first sheet tray 200 is mounted in the main casing 2 again, as illustrated in FIGS. 6A and 6B, the acting part 233 is pressed upward by the inclined surface 131 of the shutter actuating part 130 and is pivotally moved upward. The shutter member 230 is thus moved back into the opening position from the closing position, thereby opening the first conveying path 33. Since the inclined surface 131 is sloped downward toward the front side, the acting part 233 can be reliably pivotally moved, rather than getting stuck with the shutter actuating part 130, in accordance with attachment of the first sheet tray 200 to the main housing 2.

When the additional sheet-supplying device 10 is detached from the main casing 2, as illustrated in FIGS. 5A and 5B, the shutter actuating part 130 is separated from the acting part 233. The shutter member 230 is thus moved from the opening position to the closing position by its own weight. In other words, no extra operation is required for a user to close the shutter member 230 at the time of detachment of the additional sheet-supplying device 10 from the main housing 2. Operability of the laser printer 1 can be improved.

It should be noted that, in the embodiment, the first conveying path 33 is formed in the first sheet tray 200. However, alternatively, the first conveying path 33 may be formed in the main casing 2, or may be formed by the main casing 2 and the first sheet tray 200.

While the description has been made in detail with reference to specific embodiment thereof, it would be apparent to those skilled in the art that various changes and modifications may be made therein without departing from the scope of the above described embodiment.

<First Modification>

Hereinafter, a first sheet tray 300 and an additional sheet-supplying device 410 according to a first modification will be described with reference to FIGS. 8A through 10.

In the following description, like parts and components are designated by the same reference numerals as the embodiment in order to avoid duplicating description.

In the embodiment, the shutter member 230 is configured to pivotally move in order to move between the opening position and the closing position. However, the first sheet tray 300 of the first modification is provided with a shutter member 330 configured to slide, rather than pivotally move, to realize movement between the opening position and the closing position. The shutter member 330 is another example of the shutter.

Figure 8A:
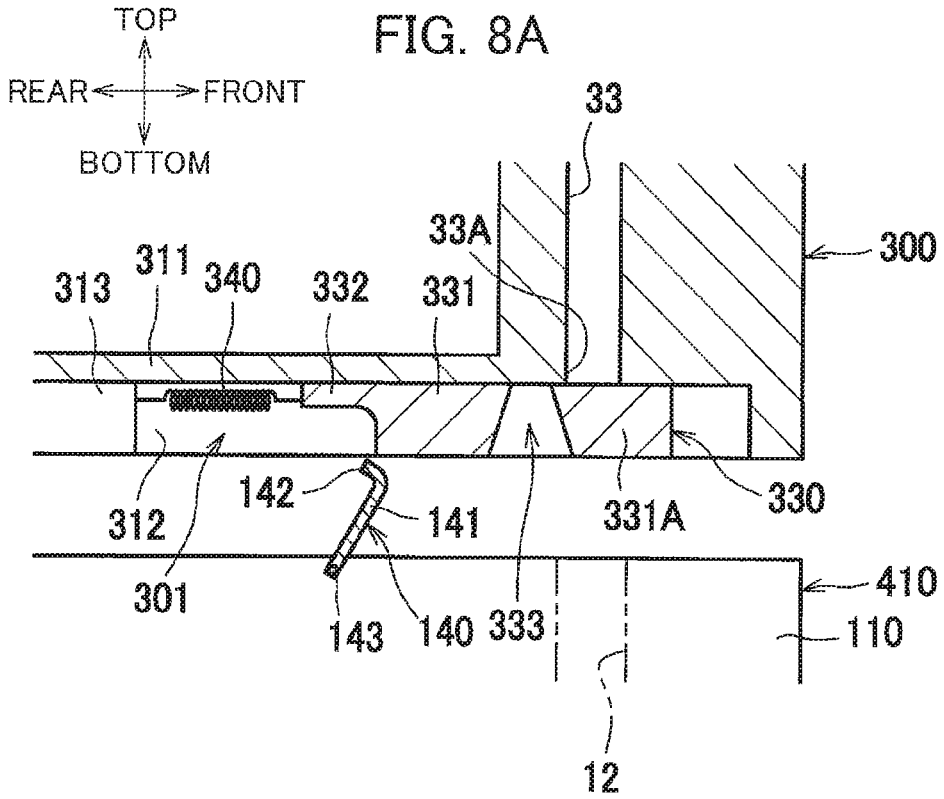
FIG. 8A is a cross-sectional view of a shutter member according to a first modification, and showing a state where the shutter member according to the first modification is at a closing position.
Figure 8B:
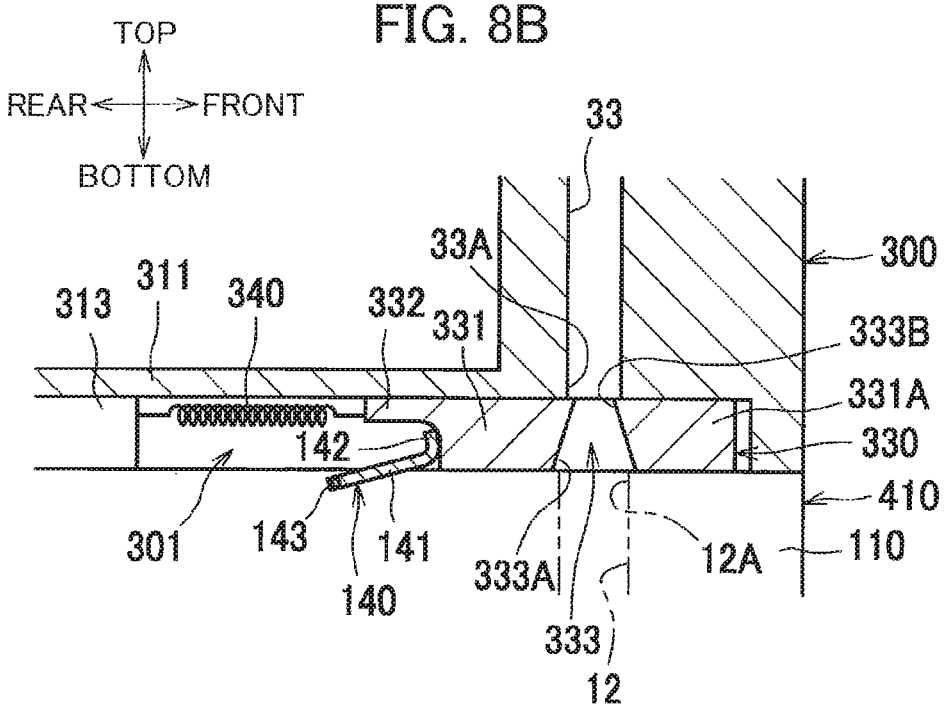
FIG. 8B is a cross-sectional view of the shutter member according to the first modification, and showing a state where the shutter member according to the first modification is at an opening position.

Specifically, as shown in FIGS. 8A and 8B, the shutter member 330 is arranged on a bottom surface of the first sheet tray 300. The shutter member 330 is configured to slide in the front-rear direction. The additional sheet-supplying device 410 of the first modification is provided with a shutter actuating member 140, instead of the shutter actuating part 130. The shutter actuating member 140 is pivotally movably provided on the side frames 110 constituting the frame 100 of the additional sheet-supplying device 410. The shutter actuating member 140 is configured to act on the shutter member 330. The shutter actuating member 140 is another example of the shutter actuating part.

Figure 9:
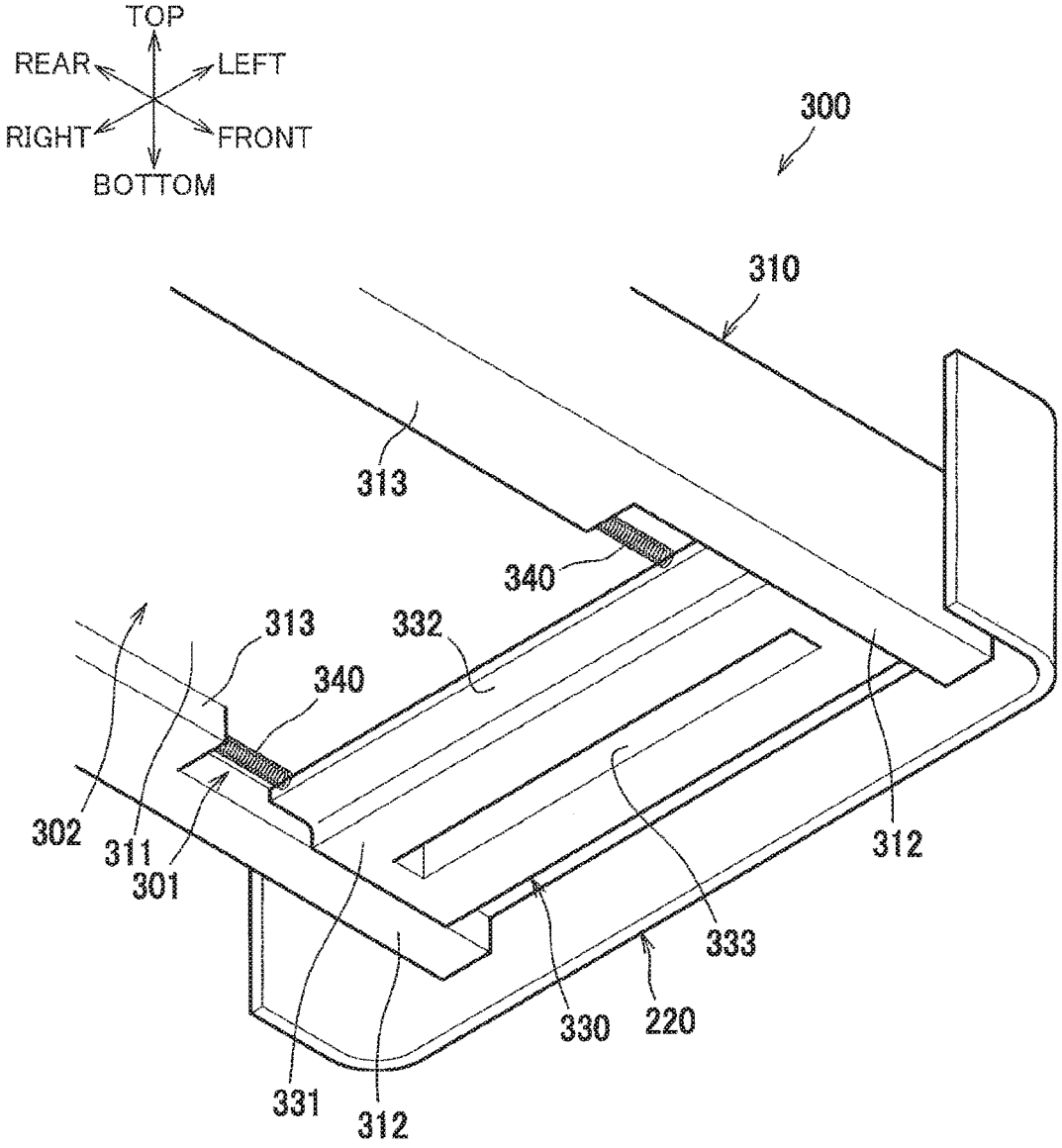
FIG. 9 is a perspective view of a first sheet tray according to the first modification as viewed from its bottom side.

As illustrated in FIG. 9, the shutter member 330 includes a plate-shaped main body part 331 and a spring engagement part 332. The plate-shaped main body part 331 is elongated in the left-right direction. The spring engagement part 332 protrudes rearward from an upper end of the main body part 331. The main body part 331 is formed with a communication path 333 penetrating the main body part 331 in the vertical direction.

The shutter member 330 is configured to slide in the front-rear direction so as to move between the opening position (FIG. 8B) and the closing position (FIG. 8A). In the opening position shown in FIG. 8B, the communication path 333 is positioned below the opening 33A and the First conveying path 33 is opened. That is, when the shutter member 330 is in the opening position, the communication path 333 provides communication between the first conveying path 33 and the second conveying path 12. In the closing position shown in FIG. 8A, a portion 331A of the main body part 331 positioned frontward of the communication path 333 is located below the opening 33A. Thus, the first conveying path 33 is closed by this portion 331A of the shutter member 330 in the closing position. In other words, this portion 331A serves as a shutter part 331A for closing the first conveying path 33 when the shutter member 330 is at the closing position.

As illustrated in FIG. 8B, in a side view, the communication path 333 is tapered toward the top in a side view. Specifically, the communication path 333 has an inlet 333A (a lower opening facing toward the second conveying path 12) and an outlet 333B (an upper opening facing toward the first conveying path 33), the inlet 333A having a lager dimension than the outlet 333B in the front-rear direction (i.e., a sliding direction of the shutter member 330). The communication path 333 has a dimension that becomes smaller toward the outlet 333B from the inlet 333A in the sliding direction of the shutter member 330 (front-rear direction).

As shown in FIG. 8B, the front-rear dimension of the inlet 333A is greater than a front-rear dimension of an exit 12A of the second conveying path 12. The front-rear dimension of the outlet 333B is smaller than a front-rear dimension of the opening 33A that is the inlet of the first conveying path 33. With this structure of the communication path 333, the leading end of the sheet P supplied from the second conveying path 12 is unlikely to get struck on gaps or steps formed between the second conveying path 12 and the communication path 333 and between the communication path 333 and the first conveying path 33.

As illustrated in FIG. 9, the first sheet tray 300 includes a tray body 310 210 having a bottom surface in which a first recessed portion 301 and a second recessed portion 302 are formed. The shutter member 330 is provided on the first recessed portion 301. The second recessed portion 302 is positioned rearward of the first recessed portion 301.

Specifically, the tray body 310 includes a pair of guide walls 312, a bottom wall 311, and a pair of protrusion walls 313. The guide walls 312 extend downward from the bottom wall 311 and are provided at positions rightward and leftward of the shutter member 330, respectively. That is, the shutter member 330 is provided between the pair of guide walls 312 in the left-right direction. Each guide walls 312 extend from a front edge of the tray body 310 so as to extend rearward beyond the opening 33A (see FIGS. 8A and 9). The guide walls 312 have a front-rear length larger than that of the shutter member 330. The protrusion walls 313 are arranged on the rear of the guide walls 312. More specifically, the protrusion walls 313 extend from rear ends of the guide walls 312 up to a rear edge of the tray body 310, although not illustrated. The protrusion walls 313 protrude further inward than the guide walls 312 do in the left-right direction. The first recessed portion 301 constitutes a portion interposed between the guide walls 312. The second recessed portion 302 constitutes a portion interposed between the protrusion walls 313.

The guide walls 312 include retaining parts (not shown) engaging the shutter member 330. Due to the engagement of the retaining parts with the shutter member 330, the shutter member 330 can be restricted from moving downward and the shutter member 330 can be retained within the first recessed portion 301.

A tension spring 340 (as an example of an urging member is disposed between the shutter member 330 and each of the protrusion walls 313. The tension springs 340 are configured to urge the shutter member 330 toward the closing position from the opening position by pulling the shutter member 330 rearward.

Figure 10:
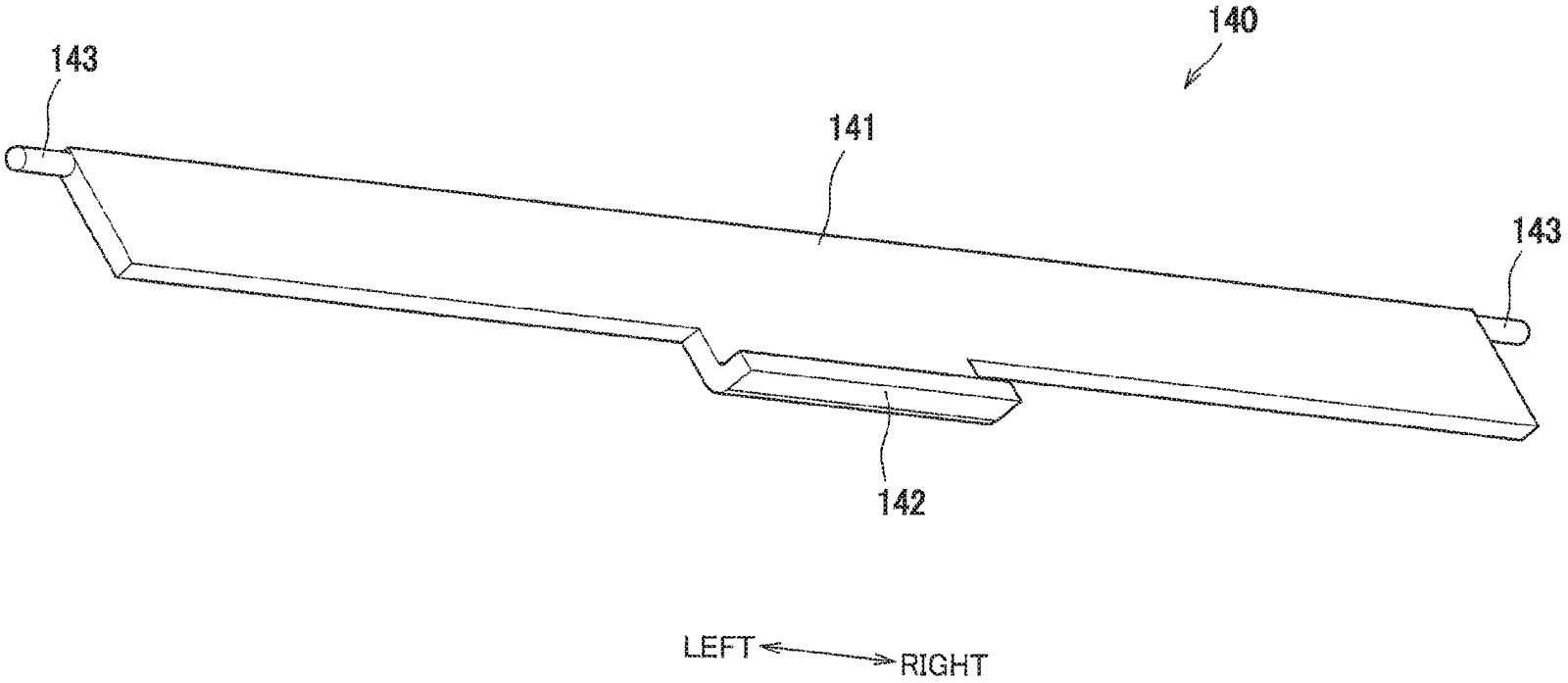
FIG. 10 is a perspective view of an actuating member according to the first modification.

Referring to FIG. 10, the shutter actuating member 140 includes a flat plate part 141, a pressing part 142, and a pair of shaft parts 143.

The plate part 141 extends in the left-right direction. That is, the front-rear direction corresponds to a short-side direction of the plate part 141.

The shaft parts 143 respectively protrude outward in the left-right direction from left and right end face of the plate part 141. More specifically, the shaft parts 143 are provided on rear ends of the respective end faces of the plate part 141. The rear end on each end face of the plate part 141 corresponds to one end in the short-side direction of the plate part 141. The shaft parts 143 are rotatably supported respectively by the side frames 110 constituting the frame 100 of the additional sheet-supplying device 410 (see FIG. 8A).

The pressing part 142 protrudes from a left-right center on a front end (another end in the short-side direction) of the plate part 141. The pressing part 142 extends parallel to the short-side direction of the plate part 141 and is then curved to extend in a thickness direction of the plate part 141 to form a substantially L-shape in a cross-sectional view.

When the additional sheet-supplying device 410 is not attached to the main casing 2, the shutter actuating member 140 takes an initial posture shown in FIG. 8A. Specifically, in the initial posture, the plate part 141 extends diagonally frontward and upward from the shaft part 143; and a free end portion of the pressing part 142 is oriented obliquely upward and rearward in a side view. The shutter actuating member 140 is urged by an urging member (not shown) such that the shutter actuating member 140 is normally pivotally moved counterclockwise in FIGS. 8A and 8B to take the initial posture. In the initial posture, the pressing part 142 of the shutter actuating member 140 is located at a position near the rear end of the main body part 331 of the shutter member 330 at the closing position in the front-rear direction.

When the main casing 2 is placed on the additional sheet-supplying device 410, the main body part 331 of the shutter member 330 abuts on the pressing part 142, thereby pivotally moving the shutter actuating member 140 forward, as illustrated in FIG. 8B. Accordingly, the pressing part 142 of the pivoting shutter actuating member 140 presses the main body part 331 of the shutter member 330, moving the shutter member 330 from the closing position to the opening position. The shutter actuating member 140 is configured to be locked at this collapsed position after being pivotally moved from the initial posture, since a stopper (not illustrated) engages the side frame 110. The engagement of the stopper with the side frame 110 prevents the shutter actuating member 140 from returning to the initial posture.

In this way, in this first modification as well, attachment of the additional sheet-supplying device 410 to the main casing 2 can automatically move the shutter member 330 the opening position. Hence, there is no need for the user to open the shutter member 330, resulting in enhanced operability.

Further, since the pressing part 142 is provided at the left-right center of the plate part 141, the pivotal movement of the shutter actuating member 140 can be realized stably without any distortion when the pressing part 142 abuts on the shutter member 330. Hence, this structure can restrain the shutter member 330 from moving obliquely and from getting caught on the guide walls 312, ensuring smooth sliding movement of the shutter member 330.

When the first sheet tray 300 is withdrawn from the main casing 2, the shutter member 330 is separated from the shutter actuating member 140, moving the shutter member 330 from the opening position to the closing position due to the urging force of the tension springs 340. At this time, the shutter actuating member 140 moves relative to the tray body 310 within the second recessed portion 302 (see FIG. 9) of the first sheet tray 300.

When the first sheet tray 300 is mounted back into the main casing 2, the main body part 331 of the shutter member 330 abuts on the pressing part 142 of the shutter actuating member 140. The shutter actuating member 140 in turn pushes the shutter member 330 forward against the urging force of the tension spring 340, while the first sheet tray 300 moves rearward. The shutter member 330 is thus slid forward relative to the first sheet tray 300 (tray body 310) and moves from the closing position to the opening position.

When the additional sheet-supplying device 410 is detached from the main casing 2, the shutter member 330 is separated from the shutter actuating member 140. The shutter member 330 is thus moved from the Opening position to the closing position due to the urging force of the tension springs 340. In this way, detachment of the additional sheet-supplying device 10 from the main casing 2 can automatically move the shutter member 330 to the closing position. The user is thus not required to perform any extra operation to open the shutter member 330. This structure of the first modification can enhance operability.

It should be noted that, in the described first modification, the shutter member 330, which is configured to slide relative to the first sheet tray 300, is retained by the first sheet tray 300 and is arranged on the bottom surface of the first sheet tray 300. However, the shutter member 330 may be held by the main casing 2, rather than the first sheet tray 300, such that the shutter member 330 is arranged on a bottom surface constituting the main casing 2.

Further, although the shutter actuating member 140 of the first modification is configured to pivotally move by being pushed down by the shutter member 330, the shutter actuating member 140 may be configured differently. For example, the shutter actuating member 140 may be provided with at least one contact part configured to be contacted by the main housing 2 attached to the additional sheet-supplying device 410. In this case, the contact part may be provided on at least one of left and right ends of the shutter actuating member 140. When the main housing 2 is attached to the additional sheet-supplying device 410, the main housing 2 contacts and pushes down the contact part, which causes the shutter actuating member 140 to pivotally move. With this structure, even without providing the stopper engageable with the side frame 110 for locking the shutter actuating member 140 in the collapses posture, the shutter actuating member 140 may be configured not to move back to the initial posture.

<Second Modification>

While the shutter member 230 is provided only in the first conveying path 33 in the embodiment, the shutter member 230 may be provided at positions different from those in the embodiment.

For example, it is conceivable that another additional sheet-supplying device is further attachable below the additional sheet-supplying device 10 that has been attached to the main casing 2. In this case, the additional sheet-supplying device 10 may be provided with the shutter member 230, just as the first sheet tray 200.

Figure 11:
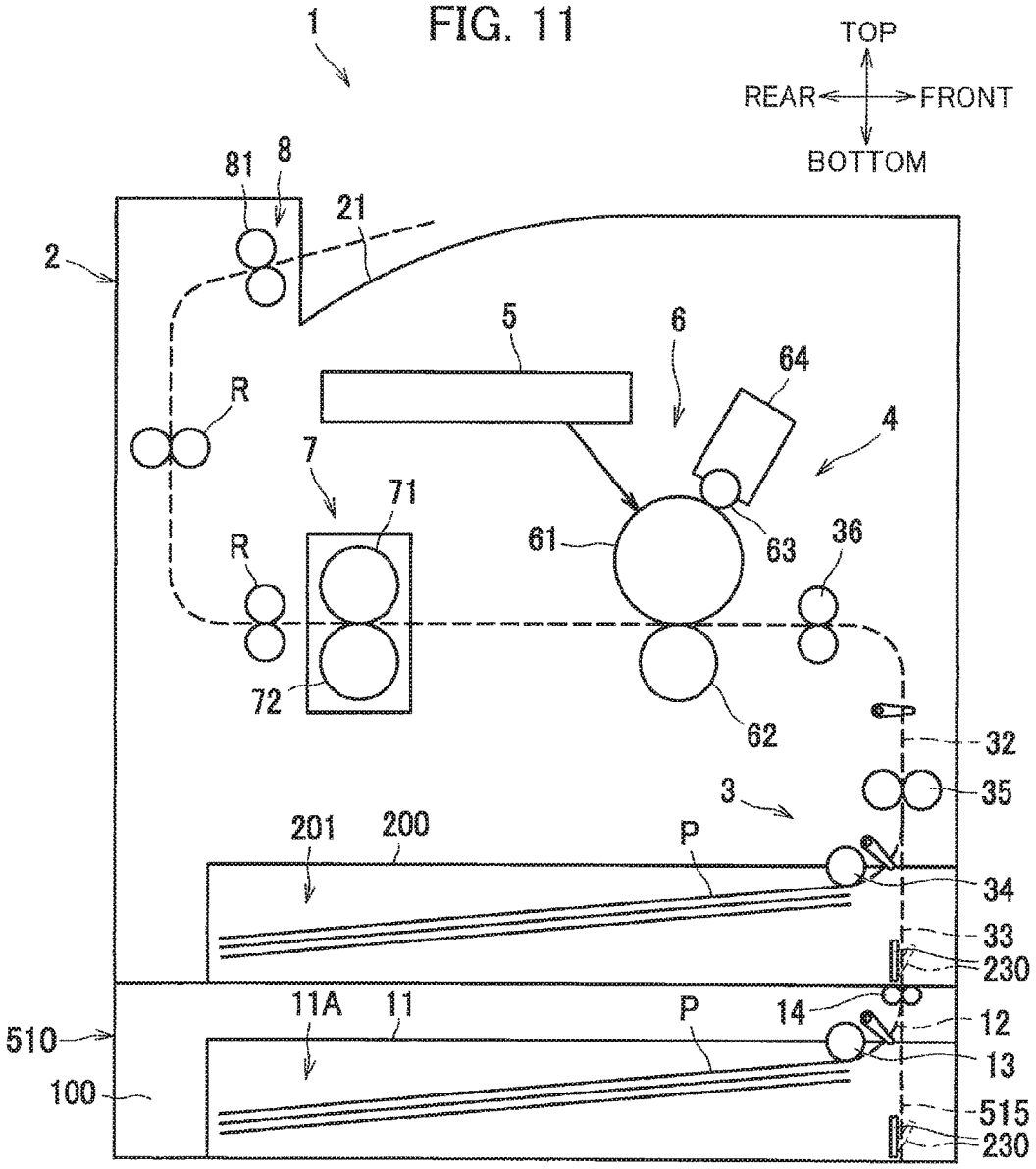
FIG. 11 is a schematic view illustrating configurations of a laser printer and an additional sheet-supplying device according to a second modification.

FIG. 11 shows a state where an additional sheet-supplying device 510 according to a second modification to the embodiment has been attached to the main casing 2 of the laser printer 1. This additional sheet-supplying device 510 has a similar configuration as the additional sheet-supplying device 10 of the embodiment, except that the second sheet tray 11 further includes a conveying path 515 in communication with the second conveying path 12, and the shutter member 230 having the same configuration as the embodiment. This conveying path 515 is open downward so that the conveying path 515 can communicate with the second conveying path 12 of another additional sheet-supplying device 10 that is to be attached below the additional sheet-supplying device 510. With this structure, the conveying path 515 is configured to receive the sheet P supplied from the another additional sheet-supplying device 10 attached below, and guide the sheet P to the second conveying path 12. The shutter member 230 is provided at an exit of the conveying path 515 for closing and opening the conveying path 515.

In this example of FIG. 11, the another additional sheet-supplying device 10 attachable to the additional sheet-supplying device 510 may have the same configuration as the additional sheet-supplying device 10, or the same configuration as the additional sheet-supplying device 510.

What is claimed is:

1. An image-forming apparatus comprising:

a casing having a bottom portion having a bottom edge configured to contact an installation surface on which the casing is placed;

a first sheet tray provided in the bottom portion of the casing, the first sheet tray including a sheet accommodation portion configured to accommodate a sheet therein;

an image-forming unit configured to form an image on the sheet supplied from the sheet accommodation portion;

a sheet supplying path configured to provide communication between the sheet accommodation portion and the image-forming unit;

a first conveying path provided in one of the casing and the first sheet tray, the first conveying path having one end formed with an opening and another end configured to communicate with the sheet supplying path, the opening being open downward;

a shutter movable between a closing position closing the first conveying path and an opening position opening the first conveying path; and a sheet-supplying device attachable to the bottom portion of the casing, the sheet-supplying device comprising:

a second sheet tray configured to accommodate a sheet therein;

a second conveying path configured to provide communication between the second sheet tray and the opening of the first conveying path; and a shutter actuating part configured to move the shutter to the opening position from the closing position upon attachment of the sheet-supplying device to the casing, the shutter being placed at the closing position when the sheet-supplying device is not attached to the casing.

2. The image-forming apparatus as claimed in claim 1, wherein the shutter is positioned higher than the bottom edge.

3. The image-forming apparatus as claimed in claim 1, wherein the shutter is configured to pivotally move between the closing position and the opening position.

4. The image-forming apparatus as claimed in claim 3, wherein the shutter has one end portion pivotally movably supported to the first sheet tray and a free end portion opposite the one end portion, the free end portion being positioned above the one end portion when the shutter is at the opening position.

5. The image-forming apparatus as claimed in claim 3, wherein the first sheet tray is configured to be detachably attached to the bottom portion of the casing in an attaching direction, wherein the shutter actuating part includes a sloped surface that slopes downward toward upstream in the attaching direction, and wherein the shutter is pivotally movably supported to the first sheet tray, the shutter being configured to abut on the sloped surface to be pivotally moved from the closing position to the opening position upon attachment of the first sheet tray to the bottom portion of the casing to which the sheet-supplying device has been attached.

6. The image-forming apparatus as claimed in claim 1, wherein the shutter is configured to slide to move between the closing position and the opening position.

7. The image-forming apparatus as claimed in claim 6, wherein the bottom portion of the casing has a casing bottom surface, the first sheet tray having a tray bottom surface, the shutter being provided at one of the casing bottom surface and the tray bottom surface.

8. The image-forming apparatus as claimed in claim 6, further comprising an urging member configured to urge the shutter toward the closing position from the opening position.

9. The image-forming apparatus as claimed in claim 6, wherein the shutter is configured to slide in a sliding direction, the shutter being formed with a communication path configured to provide communication between the first conveying path and the second conveying path when the shutter is at the opening position, the communication path having an inlet positioned near the second conveying path and an outlet positioned near the first conveying path, the inlet having a dimension larger than a dimension of the outlet in the sliding direction, the communication path having a dimension that becomes smaller toward the outlet from the inlet in the sliding direction.

10. The image-forming apparatus as claimed in claim 6, wherein the shutter actuating part is pivotally movable relative to the second sheet tray, the shutter actuating part pushing the shutter to cause the shutter to slide to the opening position from the closing position upon attachment of the sheet-supplying device to the casing.

11. The image-forming apparatus as claimed in claim 6, wherein the first sheet tray is attachable to and detachable from the bottom portion of the casing, wherein the shutter is supported by the first sheet tray and is slidable relative to the first sheet tray, the shutter actuating part abutting the shutter to cause the shutter to slide to the opening position from the closing position upon attachment of the first sheet tray to the bottom portion of the casing to which the sheet-supplying device has been attached.

12. The image-forming apparatus as claimed in claim 1, wherein at least part of the first conveying path is provided at the first sheet tray.

13. The image-forming apparatus as claimed in claim 12, wherein the image-forming unit is positioned above the first sheet tray, wherein the casing further includes a discharge mechanism disposed higher than the image-forming unit and configured to discharge the sheet received from the image-forming unit out of the casing, and wherein the first sheet tray is detachably attachable to the bottom portion of the casing in an attaching direction, the first conveying path being positioned upstream of the image-forming unit in the attaching direction, the image-forming unit being configured to convey the sheet toward downstream in the attaching direction, the discharge mechanism being configured to discharge the sheet received from the image-forming unit toward upstream in the attaching direction.

14. A sheet-supplying device comprising:

a sheet tray including a sheet accommodation portion configured to accommodate a first sheet therein;

a sheet supplying path configured to guide the first sheet supplied from the sheet accommodation portion;

a conveying path having one end formed with an opening and another end configured to communicate with the sheet supplying path, the opening being open downward, the conveying path being configured to guide a second sheet received through the opening to the sheet supplying path, the sheet supplying path being configured to also guide the second sheet supplied from the conveying path; and a shutter movable between a closing position closing the conveying path and an opening position opening the conveying path, wherein the sheet-supplying device is attachable to another sheet-supplying device such that the sheet-supplying device is positioned above the other sheet-supplying device, and wherein the shutter is at the closing position when the sheet-supplying device is not attached to the other sheet-supplying device, a portion of the other sheet-supplying device abutting the shutter and moving the shutter to the opening position from the closing position upon attachment of the sheet-supplying device to the other sheet-supplying device.

* * * * *